US008506041B2

(12) United States Patent
Osumi et al.

(10) Patent No.: US 8,506,041 B2
(45) Date of Patent: Aug. 13, 2013

(54) INK JET RECORDING APPARATUS AND IN JET RECORDING METHOD

(75) Inventors: Koichi Osumi, Chiba (JP); Keiji Hosoi, Chiba (JP)

(73) Assignee: Seiko I Infotech Inc. (JP)

( * ) Notice: Subject to any disclaimer, the term of this patent is extended or adjusted under 35 U.S.C. 154(b) by 0 days.

(21) Appl. No.: 13/138,220

(22) PCT Filed: Dec. 28, 2009

(86) PCT No.: PCT/JP2009/071815

§ 371 (c)(1),
(2), (4) Date: Aug. 12, 2011

(87) PCT Pub. No.: WO2010/106719

PCT Pub. Date: Sep. 23, 2010

(65) Prior Publication Data

US 2011/0285776 A1 Nov. 24, 2011

(30) Foreign Application Priority Data

Mar. 18, 2009 (JP) ..... 2009-065972

(51) Int. Cl.
*B41J 29/393* (2006.01)

(52) U.S. Cl.
USPC ..... 347/23; 347/19

(58) Field of Classification Search
USPC ..... 347/19, 23
See application file for complete search history.

(56) References Cited

U.S. PATENT DOCUMENTS 6,820,955 B1 * 11/2004 Usui ..... 347/7
2009/0079785 A1 * 3/2009 Fukasawa et al. ..... 347/23

FOREIGN PATENT DOCUMENTS

JP 200669003 * 3/2006 ..... 347/23

* cited by examiner

*Primary Examiner* — Julian Huffman
(74) *Attorney, Agent, or Firm* — Adams & Wilks

(57) ABSTRACT

An ink jet recording apparatus is configured to use ink containing volatile components. A recording head has nozzles for discharging the ink and a temperature sensor that detects the temperature of the ink in the nozzles. A control portion is configured to control the recording head to perform idle drive operations which causes microvibration of an ink meniscus in each of the nozzles, to perform preliminary discharge operations to discharge the ink from the plurality of nozzles, and to change a number of times of performing the idle drive operations and a number of times of performing the preliminary discharge operations according to the temperature of the ink detected by the temperature sensor.

19 Claims, 5 Drawing Sheets

INK JET RECORDING APPARATUS AND IN JET RECORDING METHOD

CROSS-REFERENCE TO RELATED APPLICATIONS

This application is a U.S. national stage application of International Application No. PCT/JP2009/071815 filed Dec. 28, 2009, claiming a priority date of Mar. 18, 2009, and published in a non-English language.

BACKGROUND OF THE INVENTION

1. Technical Field

The present invention relates to an ink jet recording apparatus and to a recording method therefor.

2. Background Art

Conventionally, there is known an ink jet recording apparatus which discharges an ink droplet from a nozzle provided in a recording head to perform recording on a recording medium. Among such ink jet recording apparatus, an ink jet recording apparatus which uses ink containing a volatile component and causes the volatile component to vaporize on a recording medium to thereby fix the ink onto the recording medium is widely used.

Further, when an ambient temperature in which the ink jet recording apparatus is used is high, or when the ink jet recording apparatus is continuously used, the temperature of the recording head becomes higher, and thus, in those cases, the temperature of ink in the nozzle also becomes higher.

In an ink jet recording apparatus which uses ink containing a volatile component, when the temperature of ink in the nozzle becomes higher, the volatile component in the ink vaporizes more, and thus, the viscosity of the ink in the nozzle increases. Therefore, discharge of ink from the recording head becomes unstable and recording cannot be appropriately performed heretofore.

Therefore, a conventional ink jet recording apparatus is disclosed in which means for detecting the temperature of a recording head is provided and the number of times of preliminary discharge operations is changed according to the temperature detected by the temperature detecting means (see Patent Literature 1).

On the other hand, another conventional ink jet recording apparatus is disclosed in which, in addition to the preliminary discharge operations, idle drive operations of minutely vibrating an ink meniscus in a nozzle are performed to suppress the viscosity increase of ink in the nozzle (see Patent Literature 2).

CITATION LIST

Patent Literature

[PTL 1] JP 2006-168041 A
[PTL 2] JP 2005-96272 A

However, in particular, with regard to a non-water-based solvent ink which has generally a high viscosity, the viscosity of the ink particularly increases by vaporization of a volatile component of the ink, and thus, unstable discharge of the ink from a recording head conspicuously occurs, which results in inappropriate recording. Therefore, recording cannot be appropriately performed heretofore merely by changing the number of times of the preliminary discharge operations according to the temperature detected by the temperature detecting means of the recording head.

Further, the viscosity increase of ink in the nozzle cannot be sufficiently suppressed heretofore merely by performing the idle drive operations of minutely vibrating an ink meniscus in the nozzle in addition to the preliminary discharge operations, which results in inappropriate recording.

The present invention has been made to solve the above-mentioned problems, and an object of the present invention is to provide an ink jet recording apparatus and a recording method therefor, which are capable of performing appropriate recording with stable discharge of ink from the recording head even when the temperature of ink in the recording head becomes higher.

SUMMARY OF THE INVENTION

In order to solve the above-mentioned problems, according to the present invention, there is provided an ink jet recording apparatus which uses ink containing a volatile component, including: a recording head including a plurality of nozzles for discharging the ink and a temperature sensor for detecting temperature of ink in the plurality of nozzles; control means for controlling the recording head to perform idle drive operations of minutely vibrating ink menisci in the plurality of nozzles and preliminary discharge operations; and changing means for changing a number of times of the idle drive operations and a number of times of the preliminary discharge operations according to the temperature detected by the temperature sensor.

Further, in order to solve the above-mentioned problems, according to another aspect of the present invention, there is provided a recording method for an ink jet recording apparatus which uses ink containing a volatile component, the ink jet recording apparatus including: a recording head comprising a plurality of nozzles for discharging the ink and a temperature sensor for detecting temperature of ink in the plurality of nozzles; and control means for controlling the recording head to perform idle drive operations of minutely vibrating ink menisci in the plurality of nozzles and preliminary discharge operations, the recording method including: a detecting step of detecting, by the temperature sensor, the temperature of the ink in the plurality of nozzles; a changing step of changing the number of times of the idle drive operations and the number of times of the preliminary discharge operations according to the temperature detected by the temperature sensor; an idle drive operation and preliminary discharge operation executing step of performing the idle drive operations and the preliminary discharge operations for the numbers of times which have been changed in the changing step; and a recording step of performing recording after the idle drive operation and preliminary discharge operation executing step.

According to the present invention, even when the temperature of ink in the recording head becomes higher, the ink may be discharged from the recording head with stability to appropriately perform recording.

DETAILED DESCRIPTION OF THE INVENTION

In the following description, an embodiment of the present invention is described in detail with reference to the attached drawings.

Figure 1:
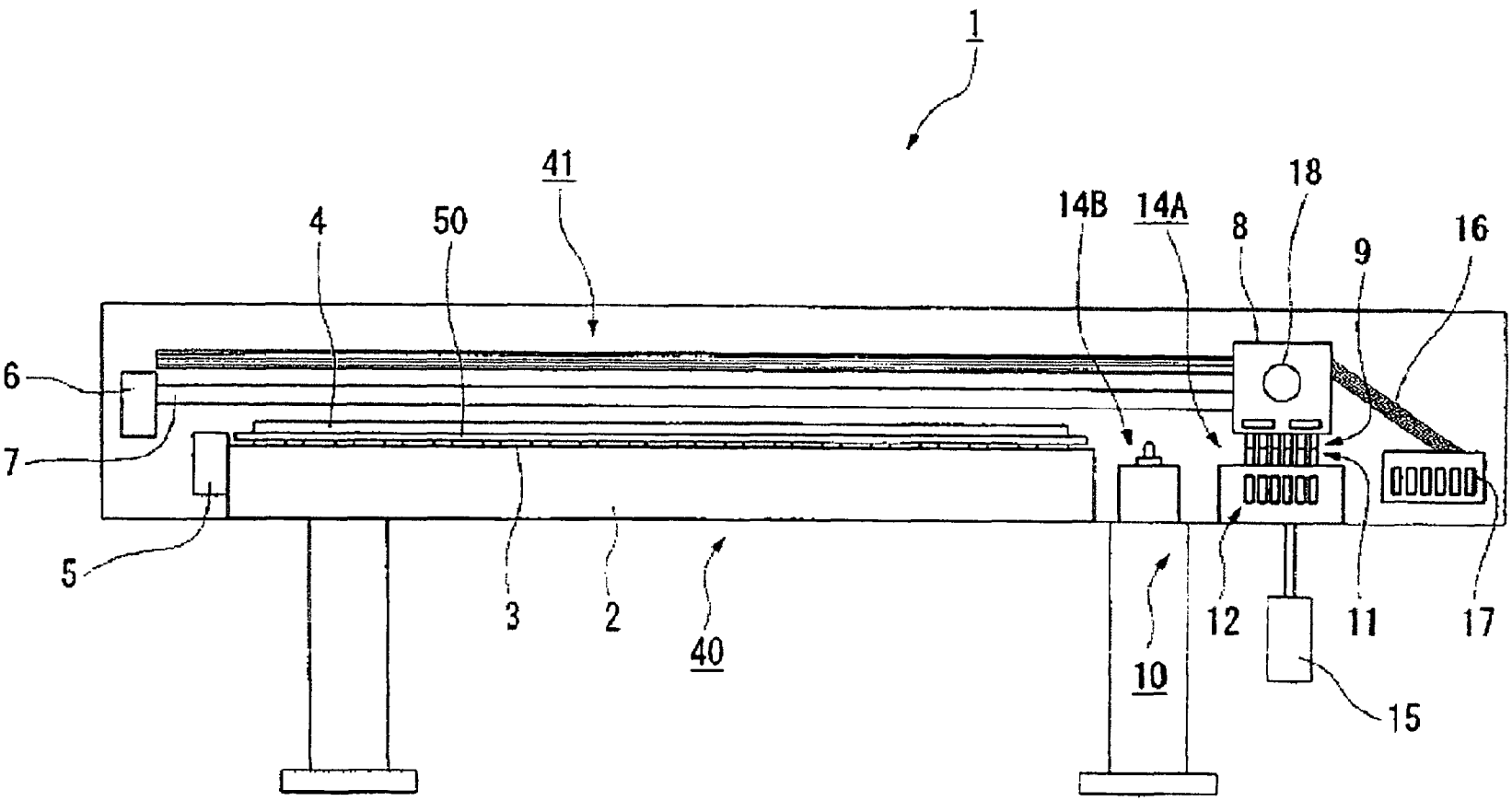
FIG. 1 is a front view schematically illustrating a structure of an ink jet recording apparatus according to a preferred embodiment of the present invention.

FIG. 1 is a front view schematically illustrating a structure of an ink jet recording apparatus according to a preferred embodiment of the present invention.

As illustrated in FIG. 1, in an ink jet recording apparatus 1 according to this embodiment, a sheet-like or plate-like recording medium 50 is horizontally positioned and transferred in a direction of the depth of the sheet of FIG. 1, and an image, a character, or the like corresponding to image data is recorded on a surface of the recording medium 50 by an ink jet system.

The ink jet recording apparatus 1 includes a transfer portion 40 for transferring the recording medium 50 and a recording portion 41 for performing recording on the recording medium 50. The ink jet recording apparatus 1 further includes a recording head 9 which reciprocatingly scans in a direction orthogonal to the direction of transfer of the recording medium 50 to perform recording, and a cleaning unit 10 for cleaning the recording head 9. Further, the ink jet recording apparatus 1 includes a control portion 20 (see FIG. 2) for controlling the apparatus as a whole including reception of image data and control of a recording operation.

The transfer portion 40 includes a plurality of pinch rollers 3 on a substantially plate-like platen 2 which is extended in the direction of the depth of the sheet of FIG. 1. The pinch rollers 3 are rotated by a motor 5 about a horizontal axis along the sheet. A plurality of grid rollers 4 supported by those pinch rollers 3 so as to be rotatable about a rotation axis parallel to the rotation axis of the pinch rollers 3 are arranged in the direction of the depth of the sheet. Those grid rollers 4 are arranged on a horizontal surface extending in the direction of the depth of the sheet of FIG. 1 above the platen 2 to form a transfer path of the recording medium 50.

The recording portion 41 includes a carriage rail 7 which is extended in the direction orthogonal to the direction of transfer of the recording medium 50 above the transfer portion 40 and the cleaning unit 10, and a recording head unit 8 movably provided along the carriage rail 7. The recording portion 41 further includes a motor 6 for reciprocating the recording head unit 8 on the carriage rail 7 while controlling the position and the speed of the recording head unit 8, and an ink cartridge 17 for supplying ink for recording to the recording head unit 8.

In this embodiment, a plurality of colors of ink for performing color recording are provided in the ink cartridge 17, and the respective colors of ink may be supplied to the recording head unit 8 via a plurality of ink tubes 16 independently.

A plurality of the recording heads 9 are provided on a lower surface side of the recording head unit 8 correspondingly to the colors of ink and the range of recording. The ink supplied from the ink tubes 16 is distributed to the recording heads 9 which perform recording in the same color. Further, a cooling fan 18 for keeping the temperature of the recording heads 9 in an appropriate temperature range is provided in the recording head unit 8.

It is to be noted that the recording head 9 is not illustrated in detail, but ink chambers for supplying ink to the respective nozzles and a discharge mechanism using piezoelectric elements or the like are provided therein. The recording head 9 is adapted to be able to discharge ink by the discharge mechanism using the piezoelectric elements or the like (including both discharge for recording and preliminary discharge not for recording) and to perform an idle drive operation of minutely vibrating (microvibrations) an ink meniscus in the nozzles (hereinafter, simply referred to as "idle drive operation"). Further, an appropriate number of the nozzles may be provided at appropriate arrangement pitches according to the structure of the discharge mechanism, the pitches of recording pixels, and the like. For example, a large number of nozzles such as 256 nozzles may be arranged.

The position control and the speed control of the motor 6 are performed in response to a control signal from the control portion 20. In the recording operation, the motor 6 reciprocates at a predetermined speed the recording head unit 8 over the recording medium 50. Further, in a cleaning operation, the motor 6 is capable of moving the recording head unit 8 to a predetermined cleaning position in the cleaning unit 10.

In this embodiment, the cleaning unit 10 includes a suction cleaning portion 14A for cleaning the recording head 9 by sucking ink in the recording head 9 out of the nozzle, and a wiping portion 14B for cleaning the recording head 9 by wiping a recording head surface. The cleaning unit 10 is arranged beside the transfer portion 40 and below the recording portion 41 on a moving path of the recording head unit 8 in the order of the wiping portion 14B and the suction cleaning portion 14A from the side of the transfer portion 40. In this embodiment, the predetermined cleaning position is a position above the suction cleaning portion 14A and the wiping portion 14B.

The suction cleaning portion 14A includes, as its schematic structure, caps 11, a cap drive portion (not shown), a suction pump 12, a pump drive portion (not shown), a pressure release valve (not shown), and a pressure release valve drive portion (not shown).

Among them, at least the caps 11 are provided for the respective recording heads 9. However, in a case where the respective operations of the cap drive portion, the suction pump 12, the pressure release valve, and the pressure release valve drive portion may be performed in common with regard to the recording heads 9, a single cap drive portion, a single suction pump 12, a single pressure release valve, and a single pressure release valve drive portion may be provided for a plurality of the caps 11.

The cap drive portion selectively switches the vertical position of the caps 11, and is constituted by, for example, appropriate mechanical, electromagnetic, or fluidic raising and lowering means. Therefore, the cap drive portion is capable of vertically reciprocating the caps 11 with respect to the recording head unit 8 which has been moved on the carriage rail 7 by the motor 6 to be positioned above the suction cleaning portion 14A, to thereby switch between a state in which the caps 11 seal the recording head surface and a state in which the seal is released.

It is to be noted that, in this embodiment, the preliminary discharge operation is performed by discharging ink from the recording head 9 to the caps 11 with the caps 11 sealing the recording head surface. However, the structure is not limited thereto, and, for example, a region dedicated for performing the preliminary discharge operation may be provided in the ink jet recording apparatus 1 and the preliminary discharge operation may be performed in the region. Further, in this embodiment, the idle drive operation of minutely vibrating the ink meniscus in the nozzles of the recording head 9 may be performed before the preliminary discharge operation or before and after the preliminary discharge operation. In this embodiment, the idle drive operation may be performed both in the state in which the caps 11 seal the recording head surface and in the state in which the caps 11 do not seal the recording head surface, for example, while the recording head 9 is scanning. However, the position at which the idle drive operation may be performed is not specifically limited.

The suction pump 12 sucks air and a content such as ink, and the like existing in space to be sucked and delivers them out of the space to be sucked, and a fluid pump having an appropriate structure, for example, a rotary pump, may be adopted. In this embodiment, the amount of suction can be changed by the pump drive portion. Further, the amount of suction by the suction pump 12 may be changed in a plurality of stages as necessary. In the suction pump 12, a suction port is connected to a suction tube, and a delivery port is connected to a delivery tube. The other end of the delivery tube is connected to a waste liquid bottle 15.

In the suction cleaning portion 14A, the cap drive portion, the pressure release valve drive portion, and the pump drive portion are electrically connected to a cleaning control portion (not shown), and their respective operations are controlled by a control signal from the cleaning control portion.

The wiping portion 14B may have any structure which performs well-known wiping processing. For example, a structure may be adopted in which the recording head surface is wiped by relatively moving a wiping blade absorbing a wiping liquid on the recording head surface of the recording head 9 which has been moved to above the wiping portion 14B. Further, although not specifically illustrated, an operation of the wiping portion 14B is also controlled by the cleaning control portion.

The ink jet recording apparatus 1 according to this embodiment is a large-format ink jet recording apparatus. The ink jet recording apparatus according to the present invention is not limited to a large-format ink jet recording apparatus, but the effect of the present invention is particularly remarkable in a large-format ink jet recording apparatus. The reason is as follows. In a large-format ink jet recording apparatus including a recording head which may scan a length of, for example, 50 inches or more in the direction of transfer of a recording medium, the scanning length of the recording head becomes larger, and thus, a time period during which the recording head is exposed to atmosphere without being capped in recording and scanning becomes longer. Therefore, in a large-format ink jet recording apparatus, if delivery of ink with the increased viscosity is insufficient, the time period during which the recording head is open to the atmosphere in recording and scanning becomes longer. Thus, the amount of ink which vaporizes from the recording head is larger than that in the case of a small-format ink jet recording apparatus, and discharge of ink is more liable to become unstable. Therefore, in a large-format ink jet recording apparatus, it is necessary to sufficiently discharge the ink with the increased viscosity.

Figure 2:
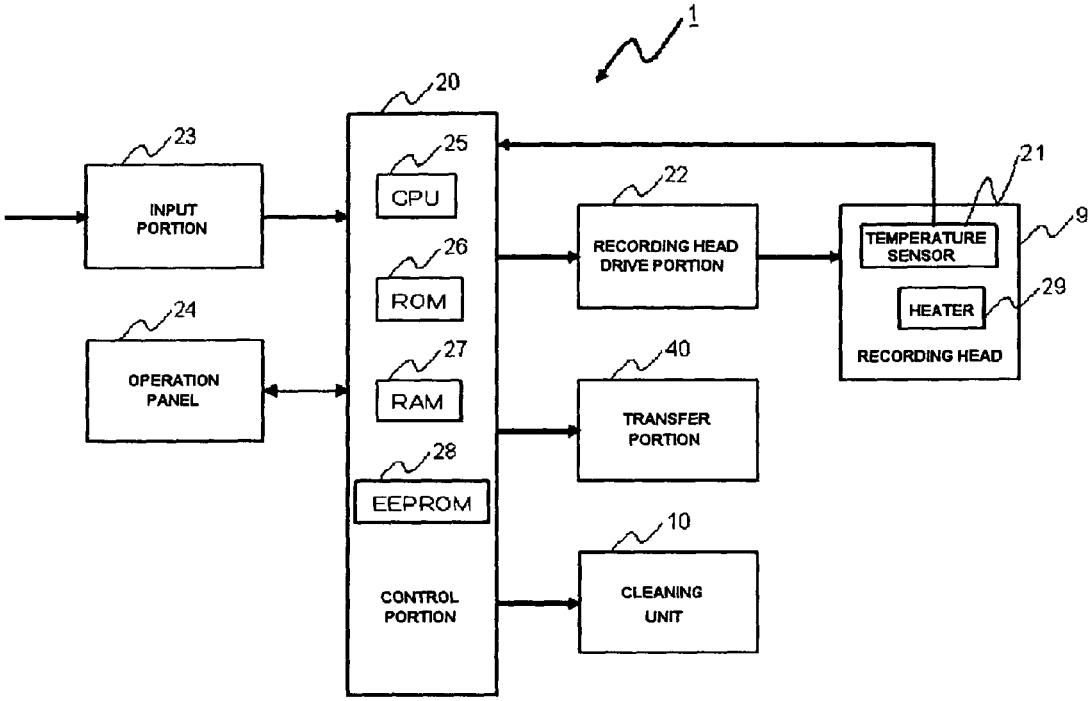
FIG. 2 is a block diagram schematically illustrating the structure of the ink jet recording apparatus according to the preferred embodiment of the present invention.

FIG. 2 is a block diagram schematically illustrating the structure of the ink jet recording apparatus according to the preferred embodiment of the present invention.

In FIG. 2, reference numeral 20 denotes the control portion. The control portion 20 includes a CPU 25 for executing processing operations such as computing, control, discrimination, and setting, a ROM 26 storing a control program to be executed by the CPU 25 and the like, and a RAM 27 used as a buffer of record data, a work area for processing by the CPU 25, and the like.

In the ink jet recording apparatus 1 according to this embodiment, the control portion 20 changes the number of times of the idle drive operations and the number of times of the preliminary discharge operations according to the temperature detected by a temperature sensor 21 included in the recording head 9 for detecting the temperature of ink in a nozzle of the recording head 9. Then, the control portion 20 causes the recording head 9 to perform the idle drive operations and the preliminary discharge operations via a recording head drive portion 22 for the changed number of times of the idle drive operations and for the changed number of times of the preliminary discharge operations, respectively.

An input portion 23 outputs to the control portion 20 record data which is input from a host computer (not shown) and the like.

An operation panel 24 includes a switch for performing operations of switching on the ink jet recording apparatus 1, maintenance, paper feed (supply of a recording medium), paper delivery (delivery of a recording medium), and other similar operations, and also includes a display screen (for example, a liquid crystal screen). The user may perform the above-mentioned operations by using the switch while viewing the display screen.

Further, in the ink jet recording apparatus 1 according to this embodiment, the user may set the number of times of the idle drive operations, the number of times of the preliminary discharge operations, and a threshold value of the temperature at which the number of times of the idle drive operations and the number of times of the preliminary discharge operations are changed. The user may set those numbers of times and the threshold value of the temperature by the operation panel 24 or by the host computer via the input portion 23.

Further, the control portion 20 according to this embodiment further includes an EEPROM 28 as a nonvolatile memory. The EEPROM 28 stores therein the number of times of the preliminary discharge operations and the number of times of the idle drive operations corresponding to temperatures. The CPU 25 reads the number of times of the preliminary discharge operations and the number of times of the idle drive operations which are stored in the EEPROM 28 corresponding to the temperature. The CPU 25 reads the numbers of times according to the temperature detected by the temperature sensor 21. In other words, the control portion 20 changes the number of times of the preliminary discharge operations and the number of times of the idle drive operations according to the temperature detected by the temperature sensor 21. Then, the control portion 20 controls, via the recording head drive portion 22, the recording head 9 to perform the preliminary discharge operations and the idle drive operations for the read numbers of times, respectively. In this embodiment, the user may set the number of times of the preliminary discharge operations, the number of times of the idle drive operations, and the threshold value of the temperature at which the number of times of the preliminary discharge operations and the number of times of the idle drive operations are changed, by the operation panel 24 or by the host computer via the input portion 23. Further, the numbers of times and the threshold value may be overwritten and stored in the EEPROM 28. It is to be noted that, as the set threshold value of the temperature becomes higher, the amount of ink which vaporizes from the nozzle at a temperature equal to or higher than the threshold value becomes larger. Thus, it is preferred that the number of times of the preliminary discharge operations and the number of times of the idle drive operations be set to be larger.

Further, in this embodiment, the temperature detected by the temperature sensor 21 may be monitored by the CPU 25 or the like from an end of the last cleaning operation so as to detect the highest temperature from the monitored temperatures, and the highest temperature may be stored in the EEPROM 28. In the ink jet recording apparatus 1 according to this embodiment, the number of times of the preliminary discharge operations and the number of times of the idle drive operations may be changed also according to the highest temperature. Once the temperature of ink rises, a large amount of a volatile component vaporizes and the ink remains in the recording head. In this case, the ink in the recording head may not be replaced until another cleaning operation. In such a case, by changing the number of times of the preliminary discharge operations and the number of times of the idle drive operations according to the above-mentioned highest temperature, unstable discharge of the ink may be prevented more effectively.

Further, a heater 29 is provided in the recording head 9 according to this embodiment. By raising the temperature of the recording head 9 to a fixed level before the start of recording, conditions for the temperature of the recording head 9 at the start of recording may be fixed.

It is to be noted that the ink jet recording apparatus 1 according to this embodiment performs the preliminary discharge after performing the idle drive operations immediately before the start of recording. Those idle drive operations make it easier to deliver ink with the increased viscosity in the preliminary discharge. In other words, the preliminary discharge is performed in the manner above for preventing a case in which the ink with the increased viscosity cannot be delivered only by performing the preliminary discharge operations immediately before the start of recording.

Further, in the ink jet recording apparatus 1 according to this embodiment, the control portion 20 exercises control so that the idle drive operations are not performed except during recording and immediately before the start of recording, that is, from input of record data to the start of recording. However, the control portion 20 may also exercise control so that the idle drive operations are performed other than during recording and immediately before the start of recording.

If such control is exercised, in order to prevent a temperature rise of ink in the head due to the idle drive operations performed except during recording and except immediately before the start of recording, it is preferred that such drive operation be performed at a lower frequency or a lower voltage than that of the idle drive operations performed immediately before the start of recording. In such an ink jet recording apparatus, the present invention may be applied by regarding the number of times of the idle drive operations after the conditions for the idle drive operation are changed as the number of times of the idle drive operations according to the present invention.

Next, ink to be used in the ink jet recording apparatus according to the present invention is described.

Ink which is preferably used in the ink jet recording apparatus according to the present invention is a so-called solvent ink containing a volatile component and using a solvent as a main solvent. With regard to ink which does not contain a volatile component, the ink does not vaporize from the nozzle, and thus, the problem to be solved by the present invention does not arise. Further, the viscosity of a water-based ink using water as a main solvent is generally low, and thus, in many cases, the viscosity of the ink does not increase so much even when a volatile component thereof vaporizes, and it is often sufficient to perform predefined preliminary discharge operations and idle drive operations.

A solvent-based ink is useful ink because the ink is excellent in fastness of a recorded image and highly suitable for even a recording medium through which ink hardly penetrates, which is less suitable for water-based ink. In a solvent-based ink, a volatile component is caused to vaporize to be fixed onto a recording medium, and thus, a solvent-based ink contains a volatile component. Further, the viscosity of a solvent-based ink is equal to or larger than about 4 mPa·s and is equal to or smaller than about 15 mPa·s at 25° C., which is generally higher than that of a water-based ink. When such an ink is used, the above-mentioned problem particularly arises, and it is desired to solve the problem. Therefore, an ink which is preferably used in the present invention is a so-called solvent ink containing a volatile component and using a solvent as a main solvent.

Ink to be used as ink for inkjet is required to have both satisfactory discharge properties for being discharged from the recording head with stability and satisfactory fastness properties with respect to a recording medium, and thus, the kind and amount of the volatile component therein differs according to performance required of the ink jet recording apparatus. The present invention is particularly effective when using ink in which the rate of change of the viscosity increase becomes the highest when the amount of the vaporized ink is equal to or larger than 30 wt % and is equal to or smaller than 60 wt % while the volatile component of the ink is vaporizing.

Figure 3:
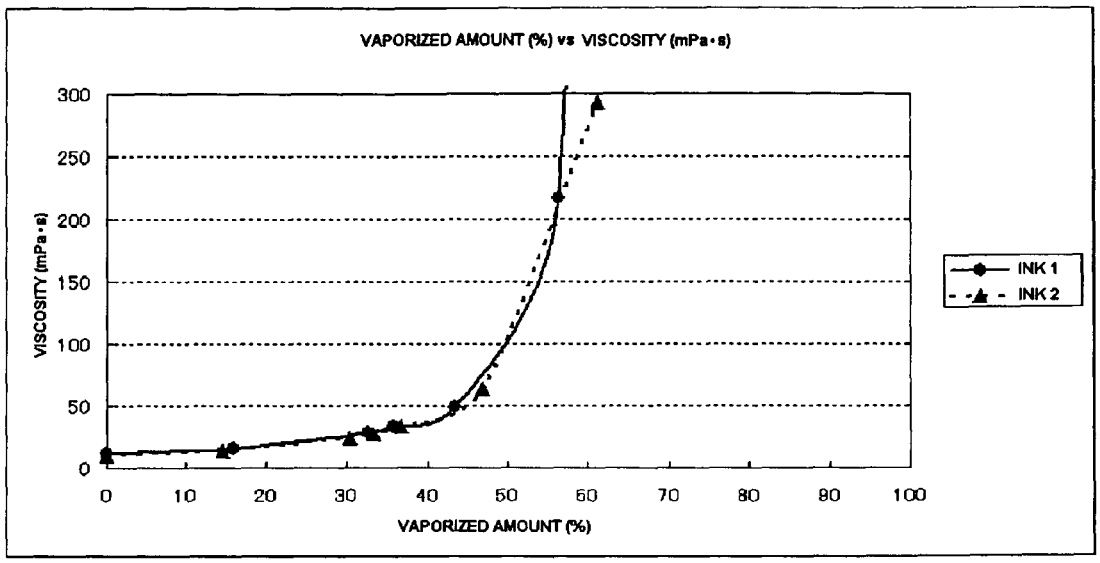
FIG. 3 is a graph of vaporization/viscosity curves with regard to three kinds of ink which may be preferably used in the embodiment of the present invention.

FIG. 3 is a graph of vaporization/viscosity curves with regard to two kinds of ink which may be preferably used in this embodiment.

In FIG. 3, ink 1 is EG-Outdoor black ink (manufactured by Seiko I Infotech Inc.) and ink 2 is eCryster black ink (manufactured by Seiko I Infotech Inc.). FIG. 3 is obtained by plotting the viscosities with respect to the vaporized amounts of the respective inks, the vaporized amounts being measured as expressed in terms of weight of those inks vaporized at 60° C. and 3 mmHg using a vacuum chamber (VOS-601SD manufactured by TOKYO RIKAKIKAI CO., LTD.), and the viscosities being measured by a viscometer (E type viscometer TV-33 manufactured by TOKI SANGYO CO., LTD.).

As can be seen from FIG. 3, with regard to both of the above-mentioned ink 1 and ink 2, the rate of change of the viscosity increase becomes the highest when the amount of the vaporized ink is equal to or larger than 40 wt % and is equal to or smaller than 50 wt %.

However, the present invention is not limited to the case of using the inks which exhibit the vaporization/viscosity curves illustrated in FIG. 3.

Next, a recording method according to the present invention is described.

Figure 4:
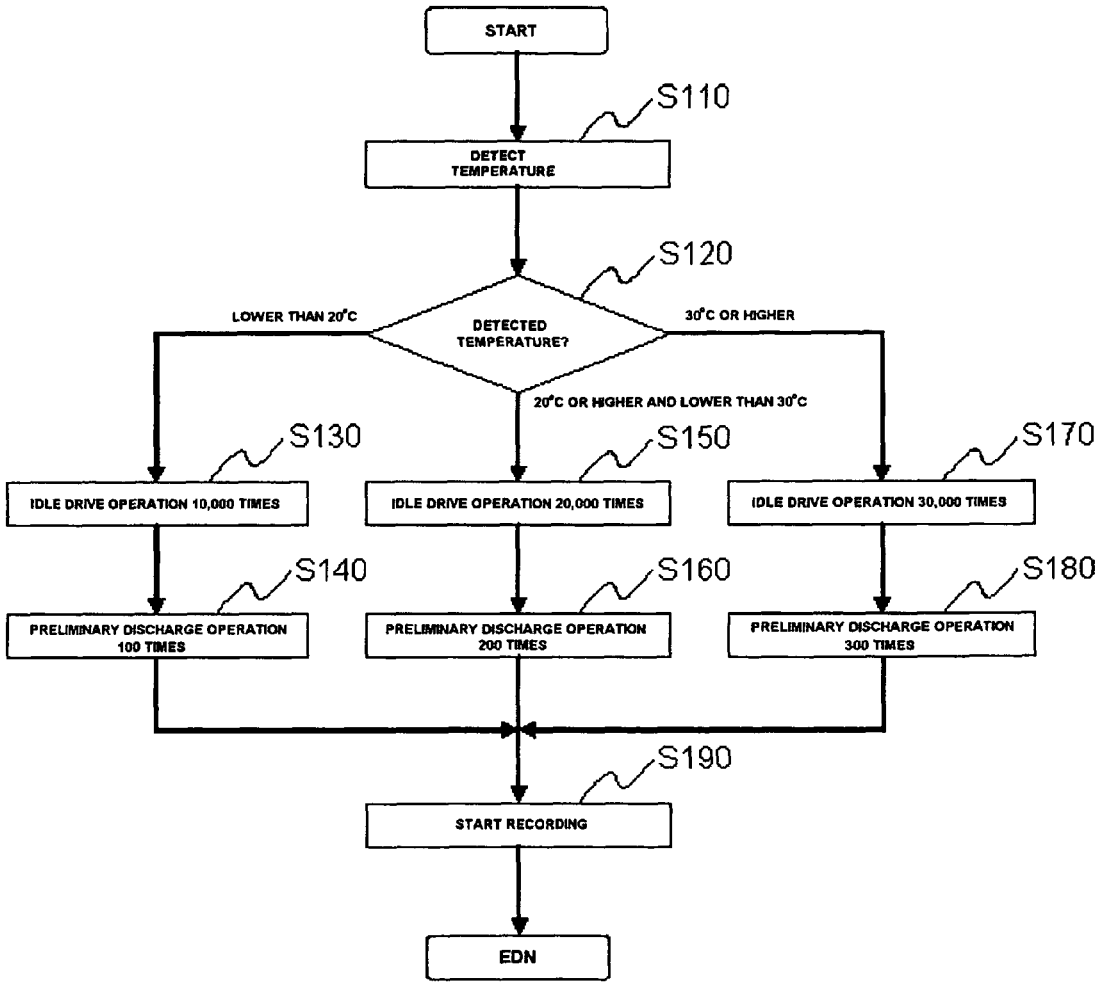
FIG. 4 is a flow chart illustrating a preferred embodiment of a recording method of the present invention.

FIG. 4 is a flow chart illustrating Example 1, which is a preferred embodiment of the recording method of the present invention.

In the ink jet recording apparatus 1, when record data is input from the host computer, first, in Step S110, the temperature sensor 21 detects the temperature. It is to be noted that, in this embodiment, the temperature sensor 21 detects the temperature after the record data is input.

Next, in Step S120, the control portion 20 determines whether the temperature detected in Step S110 is lower than 20° C., is equal to or higher than 20° C. and lower than 30° C., or is equal to or higher than 30° C. It is to be noted that, in this embodiment, two threshold values, i.e., 20° C. and 30° C., of the temperature ranges for changing the number of times of the idle drive operations and the number of times of the preliminary discharge operations are provided, but the number of the threshold values may be one or may be three or more. However, as the number of the threshold values provided is larger, a more satisfactory state of discharge may be obtained suitably. It is to be noted that, with regard to the plurality of temperature ranges delimited by those plurality of threshold values, it is desired to set a larger number of times of the idle drive operations and a larger number of times of the preliminary discharge operations as the temperature range becomes higher.

When it is determined in Step S120 that the detected temperature is lower than 20° C., the procedure proceeds to Step S130 and the idle drive operation is performed 10,000 times. After that, the procedure proceeds to Step S140 and the preliminary discharge operation is performed 100 times. After that, the procedure proceeds to Step S190 and recording is started.

Further, when it is determined in Step S120 that the detected temperature is equal to or higher than 20° C. and lower than 30° C., the procedure proceeds to Step S150 and the idle drive operation is performed 20,000 times. After that, the procedure proceeds to Step S160 and the preliminary discharge operation is performed 200 times. After that, the procedure proceeds to Step S190 and recording is started.

Further, when it is determined in Step S120 that the detected temperature is equal to or higher than 30° C., the procedure proceeds to Step S170 and the idle drive operation is performed 30,000 times. After that, the procedure proceeds to Step S180 and the preliminary discharge operation is performed 300 times. After that, the procedure proceeds to Step S190 and recording is started.

It is to be noted that, in the above-mentioned Steps S130 to S180, the preliminary discharge operations are performed after the idle drive operations, but the order is not limited thereto, and a predetermined number of times of the idle drive operations and a predetermined number of times of the preliminary discharge operations may be repeated alternately. For example, a sequence in which 1,000 idle drive operations are performed and then 10 preliminary discharge operations are performed may be repeated 10 times when the detected temperature is determined to be lower than 20° C., may be repeated 20 times when the detected temperature is determined to be equal to or higher than 20° C. and lower than 30° C., and may be repeated 30 times when the detected temperature is determined to be equal to or higher than 30° C.

In Step S190, recording is started. By performing recording, processing of the recording method according to this embodiment ends.

Figure 5:
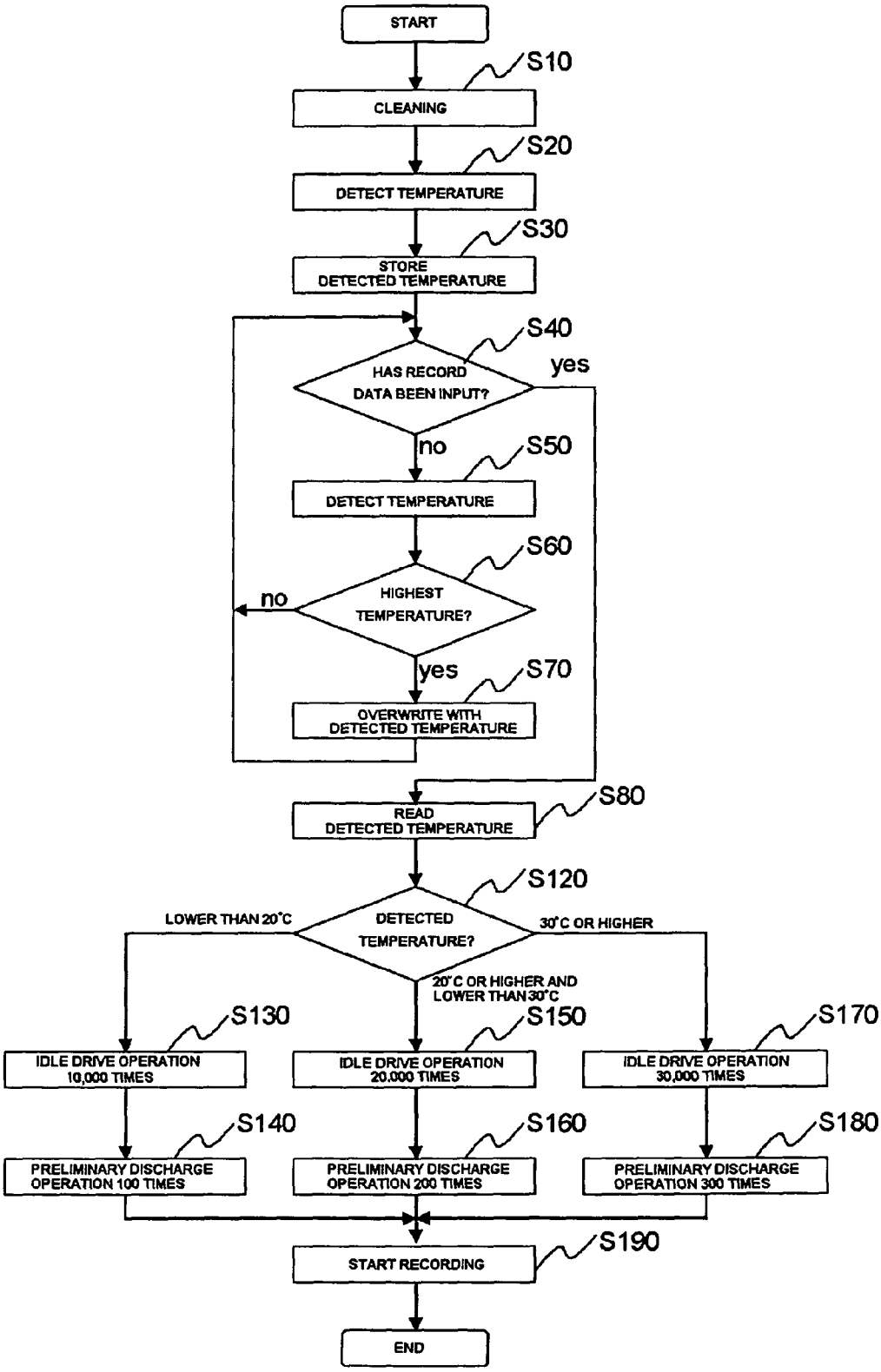
FIG. 5 is a flow chart illustrating a preferred embodiment of the recording method of the present invention.

FIG. 5 is a flow chart illustrating Example 2, which is a preferred embodiment of the recording method of the present invention.

In the ink jet recording apparatus 1, cleaning is performed in Step S10, and the temperature sensor 21 detects the temperature in Step S20. Then, in Step S30, the temperature detected in Step S20 is stored in the EEPROM 28.

Then, in Step S40, it is determined whether record data has been input from the host computer or not. When it is determined in Step S40 that record data has been input from the host computer, the procedure proceeds to Step S80.

On the other hand, when it is determined in Step S40 that record data has not been input from the host computer, the procedure proceeds to Step S50. In Step S50, the temperature sensor 21 detects the temperature. Then, in Step S60, the control portion 20 determines whether the temperature detected in Step S50 is higher than the temperature stored in the EEPROM 28. When the temperature detected in Step S50 is higher than the temperature stored in the EEPROM 28, the temperature detected in Step S50 is overwritten in Step S70 as the highest temperature, and the procedure returns to Step S40. When the temperature detected in Step S50 is equal to or lower than the temperature stored in the EEPROM 28, the procedure returns to Step S40 with no overwriting.

When record data is input from the host computer in Step S40, the temperature stored in the EEPROM 28 is read in Step S80, and the procedure proceeds to Step S120. In Step S120, the read temperature is regarded as the detected temperature and processing similar to Step S120 illustrated in FIG. 4 of the recording method of Example 1 is carried out.

It is to be noted that Steps S130 to S190 are processing similar to the corresponding steps illustrated in FIG. 4 of the recording method of Example 1, and thus, description in detail thereof is omitted.

The ink jet recording apparatus and the recording method according to the present invention described above may be applied to an ordinary ink jet recording apparatus.

REFERENCE SIGNS LIST

1 recording apparatus
9 recording head
20 control portion
21 temperature sensor

The invention claimed is:

1. An ink jet recording apparatus configured to use ink containing a volatile component, the ink jet recording apparatus comprising:

a recording head comprising a plurality of nozzles for discharging the ink and a temperature sensor for detecting the temperature of the ink in the plurality of nozzles;

control means for controlling the recording head to perform idle drive operations which cause minute vibrations of ink menisci in the plurality of nozzles and to perform preliminary discharge operations to discharge the ink from the plurality of nozzles;

changing means for changing a number of times of performing the idle drive operations and a number of times of performing the preliminary discharge operations according to the temperature of the ink detected by the temperature sensor;

cleaning means for cleaning the recording head;

detecting means for monitoring the temperature detected by the temperature sensor and detecting a highest temperature from an end of a last cleaning operation performed by the cleaning means; and storing means for storing the detected highest temperature;

wherein the changing means uses the highest temperature as the temperature detected by the temperature sensor and changes the number of times of the idle drive operations and the number of times of the preliminary discharge operations according to the highest temperature.

2. An ink jet recording apparatus according to claim 1; further comprising setting means for setting by a user the number of times of performing the idle drive operations and the number of times of performing the preliminary discharge operations.

3. An ink jet recording apparatus according to claim 2; further comprising second setting means for setting a threshold value of temperature at which the changing means changes the number of times of performing the idle drive operations and the number of times of performing the preliminary discharge operations.

4. An ink jet recording apparatus according to claim 2; further comprising second setting means for setting two or more threshold values of temperatures at which the changing means changes the number of times of performing the idle drive operations and the number of times of performing the preliminary discharge operations.

5. An ink jet recording apparatus according to claim 2; wherein the ink contains a solvent as a main component.

6. An ink jet recording apparatus according to claim 2; wherein a rate of change of viscosity increase of the ink becomes highest when a vaporized amount of the ink is equal to or larger than 30 wt % and is equal to or smaller than 60 wt % while the volatile component of the ink is vaporizing.

7. An ink jet recording apparatus according to claim 1; further comprising setting means for setting a threshold value of temperature at which the changing means changes the number of times of performing the idle drive operations and the number of times of performing the preliminary discharge operations.

8. An ink jet recording apparatus according to claim 1; further comprising setting means for setting two or more threshold values of temperatures at which the changing means changes the number of times of performing the idle drive operations and the number of times of performing the preliminary discharge operations.

9. An ink jet recording apparatus according to claim 1; wherein the ink contains a solvent as a main component.

10. An ink jet recording apparatus according to claim 1; wherein a rate of change of viscosity increase of the ink becomes highest when a vaporized amount of the ink is equal to or larger than 30 wt % and is equal to or smaller than 60 wt % while the volatile component of the ink is vaporizing.

11. A recording method for an ink jet recording apparatus configured to use ink containing a volatile component, the method comprising:

providing an ink jet recording apparatus that includes a recording head comprising a plurality of nozzles for discharging the ink and a temperature sensor for detecting the temperature of the ink in the plurality of nozzles and control means for controlling the recording head to perform idle drive operations which cause minute vibrations of ink menisci in the plurality of nozzles and to perform preliminary discharge operations to discharge the ink from the plurality of nozzles;

detecting, by the temperature sensor of the recording head, the temperature of the ink in the plurality of nozzles;

changing a number of times of performing the idle drive operations and a number of times of performing the preliminary discharge operations according to the temperature detected by the temperature sensor;

cleaning the recording head;

monitoring the temperature detected by the temperature sensor and detecting a highest temperature from an end of a last cleaning operation performed by the cleaning means; and storing the detected highest temperature;

wherein the changing step uses the highest temperature as the temperature detected by the temperature sensor and changes the number of times of the idle drive operations and the number of times of the preliminary discharge operations according to the highest temperature;

performing each of the idle drive operations and the preliminary discharge operations for a number of times corresponding to the changed number of times to cause discharge of the ink from the plurality of nozzles; and performing recording on a recording medium by the discharged ink after the idle drive operations and the preliminary discharge operations are performed.

12. A method according to claim 11; further comprising setting a number of times of performing the idle drive operations and a number of times of performing the preliminary discharge operations.

13. A method according to claim 11; further comprising setting a threshold value of temperature at which the changing means changes the number of times of performing the idle drive operations and the number of times of performing the preliminary discharge operations.

14. An ink jet recording apparatus configured to use ink containing volatile components, the ink jet recording apparatus comprising:

a recording head comprising a plurality of nozzles that discharge the ink, and a temperature sensor that detects the temperature of the ink in the nozzles; and a control portion configured to control the recording head to perform idle drive operations which cause microvibration of an ink meniscus in each of the nozzles, to perform preliminary discharge operations to discharge the ink from the plurality of nozzles, and to change a number of times of performing the idle drive operations and a number of times of performing the preliminary discharge operations according to the temperature of the ink detected by the temperature sensor;

cleaning means for cleaning the recording head;

detecting means for monitoring the temperature detected by the temperature sensor and detecting a highest temperature from an end of a last cleaning operation performed by the cleaning means; and storing means for storing the detected highest temperature;

wherein the changing means uses the highest temperature as the temperature detected by the temperature sensor and changes the number of times of performing the idle drive operations and the number of times of performing the preliminary discharge operations according to the highest temperature.

15. An ink jet recording apparatus according to claim 14; further comprising setting means for setting a number of times of performing the idle drive operations and a number of times of performing the preliminary discharge operations.

16. An ink jet recording apparatus according to claim 14; further comprising setting means for setting a threshold value of temperature at which the changing means changes the number of times of performing the idle drive operations and the number of times of performing the preliminary discharge operations.

17. An ink jet recording apparatus according to claim 14; further comprising setting means for setting two or more threshold values of temperatures at which the changing means changes the number of times of performing the idle drive operations and the number of times of performing the preliminary discharge operations.

18. An ink jet recording apparatus according to claim 14; wherein the ink contains a solvent as a main component.

19. An ink jet recording apparatus according to claim 14; wherein a rate of change of viscosity increase of the ink becomes highest when a vaporized amount of the ink is equal to or larger than 30 wt % and is equal to or smaller than 60 wt % while the volatile component of the ink is vaporizing.

* * * * *